US008950658B2

(12) United States Patent
Aldridge

(10) Patent No.: US 8,950,658 B2
(45) Date of Patent: Feb. 10, 2015

(54) FLIP OPEN STADIUM PACKAGE FOR CONSUMABLE PRODUCTS

(75) Inventor: Allen Aldridge, South Orange, NJ (US)

(73) Assignee: Kraft Foods Global Brands LLC, Northfield, IL (US)

( * ) Notice: Subject to any disclaimer, the term of this patent is extended or adjusted under 35 U.S.C. 154(b) by 337 days.

(21) Appl. No.: 13/380,458

(22) PCT Filed: Jun. 23, 2010

(86) PCT No.: PCT/US2010/039661

§ 371 (c)(1), (2), (4) Date: Mar. 12, 2012

(87) PCT Pub. No.: WO2010/151591

PCT Pub. Date: Dec. 29, 2010

(65) Prior Publication Data

US 2012/0160852 A1 Jun. 28, 2012

Related U.S. Application Data

(60) Provisional application No. 61/269,286, filed on Jun. 23, 2009.

(51) Int. Cl.

| | |
|---|---|
| ***B65D 25/06*** | (2006.01) |
| ***B65D 5/4805*** | (2006.01) |
| ***B65D 5/54*** | (2006.01) |
| ***B65D 5/18*** | (2006.01) |
| ***B65D 5/66*** | (2006.01) |
| ***B65D 85/60*** | (2006.01) |

(52) U.S. Cl.

CPC ..... *B65D 5/5495* (2013.01); *B65D 5/18* (2013.01); *B65D 5/6685* (2013.01); *B65D 85/60* (2013.01); *Y10S 206/80* (2013.01)

USPC ..... 229/120.011; 206/38; 206/800

(58) Field of Classification Search

USPC ..... 229/87.07, 120.01, 120.09, 120.18, 229/120.011; 206/38, 256, 257, 264, 800

See application file for complete search history.

(56) References Cited

U.S. PATENT DOCUMENTS

| | | | | |
|---|---|---|---|---|
| 276,171 | A | 4/1883 | Fraser | |
| 982,292 | A * | 1/1911 | Naramore et al. | 206/38 |
| 1,428,226 | A | 9/1922 | Ganz | |
| 1,704,531 | A | 3/1929 | Coombs | |
| 1,917,741 | A | 7/1933 | Tanner | |
| 2,046,484 | A * | 7/1936 | Ringler | 206/256 |

(Continued)

FOREIGN PATENT DOCUMENTS

| | | |
|---|---|---|
| JP | 55-115929 | 8/1980 |
| JP | 2007-537105 | 12/2007 |

(Continued)

*Primary Examiner* — Gary Elkins

(74) *Attorney, Agent, or Firm* — Hoffmann & Baron, LLP

(57) ABSTRACT

Exemplary embodiments include a package assembly for containing consumable product. The package assembly includes a package housing defining a pair of product pockets connected by, and rotatable about, a perforated fold line. The package housing has a closed position wherein the pair of product pockets are substantially coplanar with one another and an open position wherein the pair of pockets lie in an adjacent overlapping tiered relation. The package housing is foldable at the perforated fold line to rotate the pair of pockets between the closed position and the open position and the pair of pockets are severable at the perforated fold line to disconnect the pair of pockets from each other.

27 Claims, 10 Drawing Sheets

(56) References Cited

U.S. PATENT DOCUMENTS

| | | | | |
|---|---|---|---|---|
| 2,074,451 | A | 3/1937 | Berberian | |
| 2,320,018 | A * | 5/1943 | Ullman | 229/120.18 |
| 2,651,449 | A | 9/1953 | Burnett | |
| 2,774,468 | A | 12/1956 | Rous | |
| 3,241,738 | A | 3/1966 | Freiman | |
| 4,070,489 | A * | 1/1978 | Pahnke | 229/120.09 |
| 4,294,353 | A | 10/1981 | Focke et al. | |
| 4,377,237 | A | 3/1983 | Pawlowski | |
| 4,618,090 | A | 10/1986 | Cortellucci | |
| 5,180,056 | A | 1/1993 | Adams et al. | |
| 5,205,403 | A | 4/1993 | DeBlasio | |
| 5,251,748 | A | 10/1993 | Adams et al. | |
| 5,533,667 | A | 7/1996 | Gale | |
| 6,644,488 | B1 | 11/2003 | Coleman | |
| D513,645 | S | 1/2006 | Bray et al. | |
| D520,182 | S | 5/2006 | Bray et al. | |
| 7,159,717 | B2 | 1/2007 | Aldridge et al. | |
| 7,325,686 | B2 | 2/2008 | Aldridge | |
| 8,028,837 | B2 | 10/2011 | Gerstle et al. | |
| 8,141,707 | B2 * | 3/2012 | Robbins et al. | 229/120.011 |
| 2005/0150788 | A1 | 7/2005 | Feusner | |
| 2005/0252809 | A1 | 11/2005 | Aldridge et al. | |
| 2005/0269233 | A1 | 12/2005 | Aldridge | |
| 2007/0074995 | A1 | 4/2007 | Weisskopf | |
| 2008/0197178 | A1 | 8/2008 | Aldridge et al. | |
| 2010/0294775 | A1 | 11/2010 | Gainey et al. | |

FOREIGN PATENT DOCUMENTS

| | | | |
|---|---|---|---|
| WO | 2008027436 | A2 | 3/2008 |
| WO | 2008042632 | A1 | 10/2008 |
| WO | WO2008/153954 | A1 | 12/2008 |

* cited by examiner

FLIP OPEN STADIUM PACKAGE FOR CONSUMABLE PRODUCTS

This application claims the benefit of priority to U.S. Provisional Patent Application Ser. No. 61/269,286 filed on Jun. 23, 2009, the disclosure of which is incorporated by reference herein in its entirety for all purposes.

FIELD OF THE INVENTION

The present invention relates generally to a packaging assembly for containing and dispensing consumable products. More particularly, the present invention relates to a packaging assembly, with offset holders, for containing and dispensing gum slabs.

BACKGROUND OF THE INVENTION

Chewing gum is currently available to consumers in a variety of different formats. These include stick gum, slab gum, pellet gum, extruded gum, and others. In recent years, packaging for gum has undergone various changes. A variety of types of gum packaging, including certain types of packaging used predominantly for one or the other of the gum formats, are available to consumers.

Many of these packages provide both aesthetic and functional features which make the package desirable to the consumer. Certain of the desirable features include an aesthetically designed packaging cover which overlies an open portion of the package and is openable to expose the gum pieces for dispensing. Certain of the functional features include the ability to retain the gum pieces in one or more aligned arrays which allow for convenient individual dispensing of the gum pieces.

SUMMARY OF THE INVENTION

In one aspect, a package assembly for containing a plurality of consumable product is disclosed. The package assembly includes a package housing defining a pair of product pockets connected to each other and rotatable relative to each other. The package housing has a closed position wherein the pair of product pockets are substantially coplanar with one another and has an open position wherein the pair of pockets lie in an adjacent overlapping tiered relation. The housing is foldable to rotate the pair of pockets between the closed position and the open position. A line of weakness is disposed between the pair of pockets. The pair of pockets are severable from each other at the line of weakness.

In another aspect, a resizable package for holding consumable product is disclosed. The resizable package includes a first package formed by a first pocket and a second pocket having an area of weakness disposed therebetween to permit separation of the first pocket from the second pocket. The first and second pockets are rotatable with respect to the other between a closed position of the first package and an open position of the first package. The first pocket includes a slot for selectively retaining a flap extending from the second pocket to hold the first package in the closed position. The first and second pockets are substantially coplanar with one another in the closed position and lying in an adjacent overlapping offset tiered relation in the open position. The second package is formed upon disconnecting the second pocket from the first pocket at the area of weakness. The second pocket includes a slot for selectively retaining the flap extending from the second pocket to hold the second package in the closed position, the second package being smaller than the first package.

In yet another aspect, a package assembly for containing pieces of an edible product is disclosed. The package assembly includes a package housing having an upper compartment and a lower compartment. Each compartment being formed to receive and contain a plurality of individual pieces of an edible product. The upper and lower compartments being rotatable relative to each other. The package housing has a closed position wherein the upper and lower compartments are substantially coplanar with one another and an open position wherein the upper and lower compartments lie in an adjacent overlapping tiered relation. The package assembly also includes a connecting flap extending between and joining the upper and lower compartments. The upper and lower compartments are separable from each other along an area of weakness adjacent to the flap.

In further aspect, a method of resizing a package holding consumable product is disclosed. The method includes transitioning from a closed position to an open position of a package. The package has a closed position in which the first and second pockets are substantially coplanar with one another and a flap extending from the first pocket is selectively retained by a slot formed in the a front wall of the second pocket to obstruct access to the first and second pockets. The package has an open position in which the first and second pockets lie in an adjacent overlapping tiered relation upon rotating the first and second pockets with respect to each other so that openings of the first and second pockets are unobstructed by the flap. The method also includes disconnecting the second pocket from the first pocket at the area of weakness to form a second package that has the second pocket. The second pocket includes slot and the method further includes selectively retaining the flap extending from the second pocket with the slot of the second pocket to hold the second package in the closed position. The second package is smaller than the first package.

Other objects and features of the present invention will become apparent from the following detailed description considered in conjunction with the accompanying drawings. It is to be understood, however, that the drawings are designed as an illustration only and not as a definition of the limits of the invention.

DETAILED DESCRIPTION OF THE PREFERRED EMBODIMENT

Figure 1:
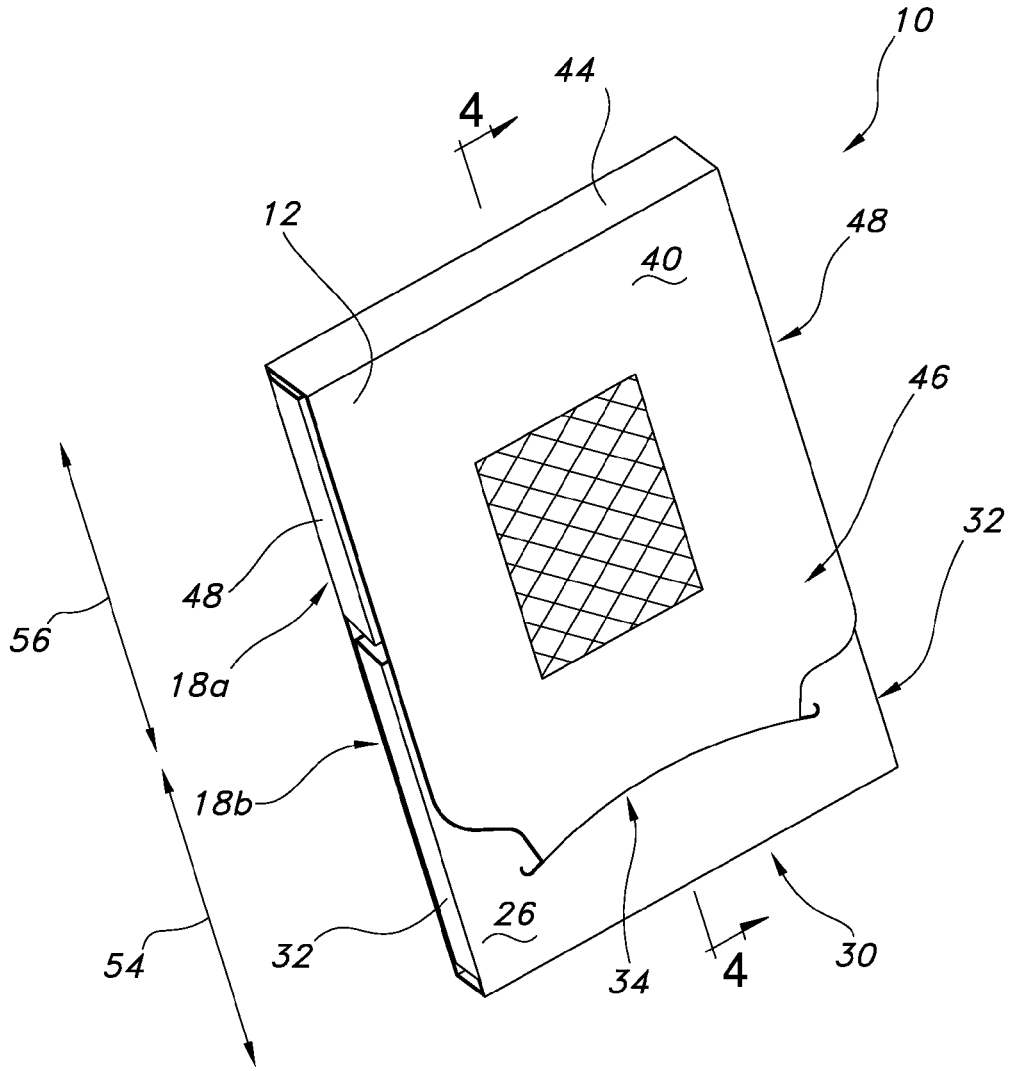
FIG. 1 shows a perspective view of a package assembly in a flat closed position that can be formed in accordance with exemplary embodiments.

Exemplary embodiments provide a resizable package assembly for enclosing and dispensing a plurality of products, such as consumable products including gum. While multi-layered gum slabs are shown in exemplary embodiments, it will be appreciated that embodiments of the package assemblies can be used to dispense a wide variety of consumable products. It is contemplated that the package assemblies may be used to contain and dispense gum pieces in various shapes, including slabs, sticks, pellets, pillows, and the like. The individual gum pieces may be wrapped or unwrapped.

With reference to the figures, package assembly 10 includes a package housing 12 which supports a plurality of gum slabs 14. While slabs are shown in a side-by-side array, other numbering and configurations of slabs is within contemplation of the present invention. The packaging assembly 10 can be positioned in a closed position (FIGS. 1 and 4) and an open position (FIG. 2) and is rotatable therebetween (FIG. 3). As particularly shown in FIG. 2, the gum slabs 14 can be arranged in a pair of side-by-side arrays when the package assembly is in the open position. The package assembly 10 can be formed from a single substantially continuous piece of material, such as paper board or other suitable material, and is used to contain and dispense comestible gum slabs 14 (FIG. 2), which can be contained in loose orientation within the packaging assembly 10 or which may be held in place using a small amount of adhesive.

The package assembly 10 includes a pair of compartments in the form of product pockets 18*a* and 18*b* (collectively referred to as "pockets 18") with interiors 20*a* and 20*b* (collectively referred to as "interiors 20"), respectively, for holding the gum slabs 14. The product pockets 18 are connected by an area of weakness which facilitates the separation of the pockets 18*a* and 18*b* from each other as will be more fully described below. The area of weakness may include a fold line 22 about which the product pockets 18 can rotate to transition between the closed and open position of the package. The product pockets 18 each include an open upper end 24 for dispensing of the gum slabs 14 therefrom. The pockets 18 are of sufficient depth to hold the gum slabs 14 therein, yet leave an upper end 14*a* of the gum slabs exposed for dispensing.

Figure 2:
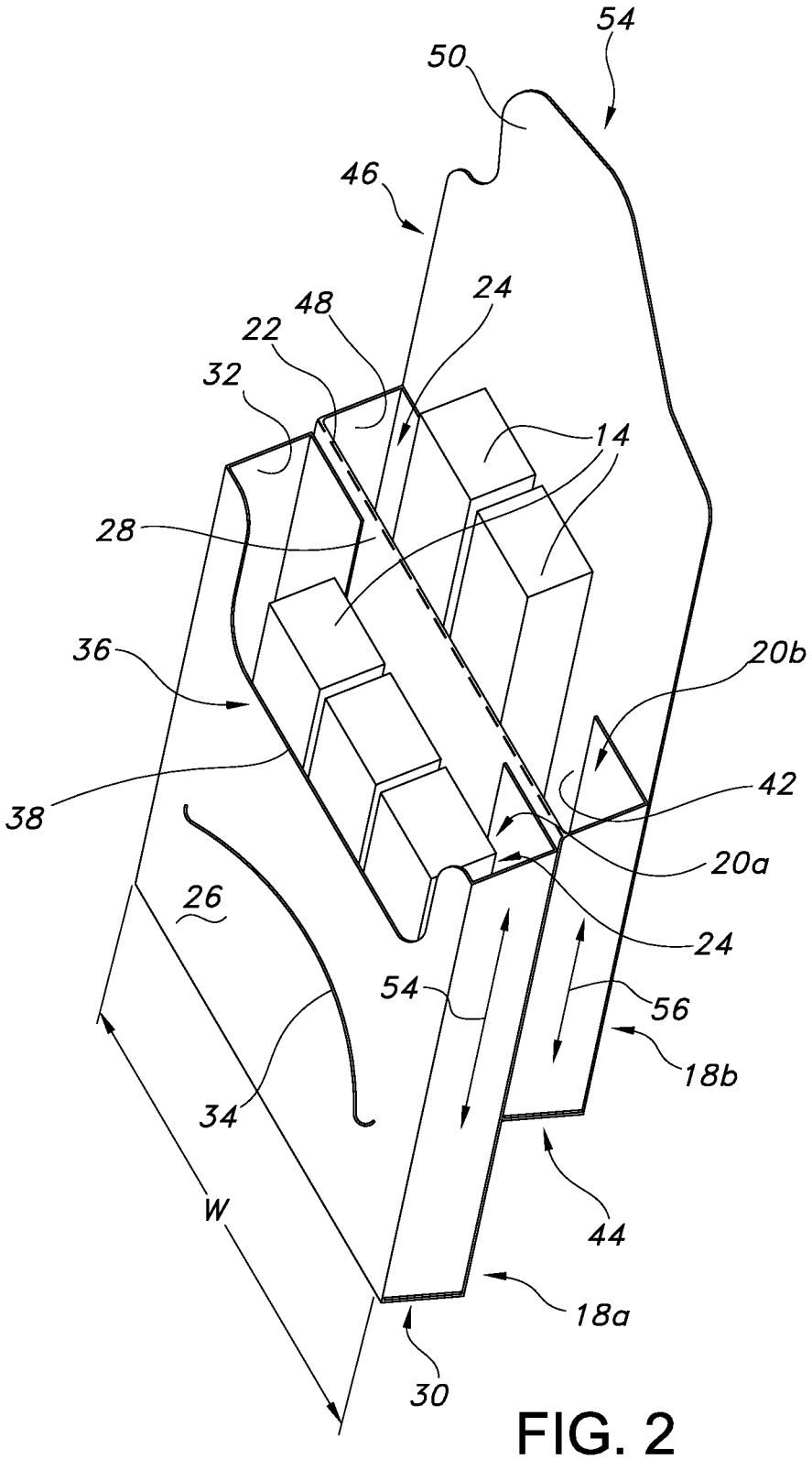
FIG. 2 shows a perspective view of the package of FIG. 1 in an open position.
Figure 3:
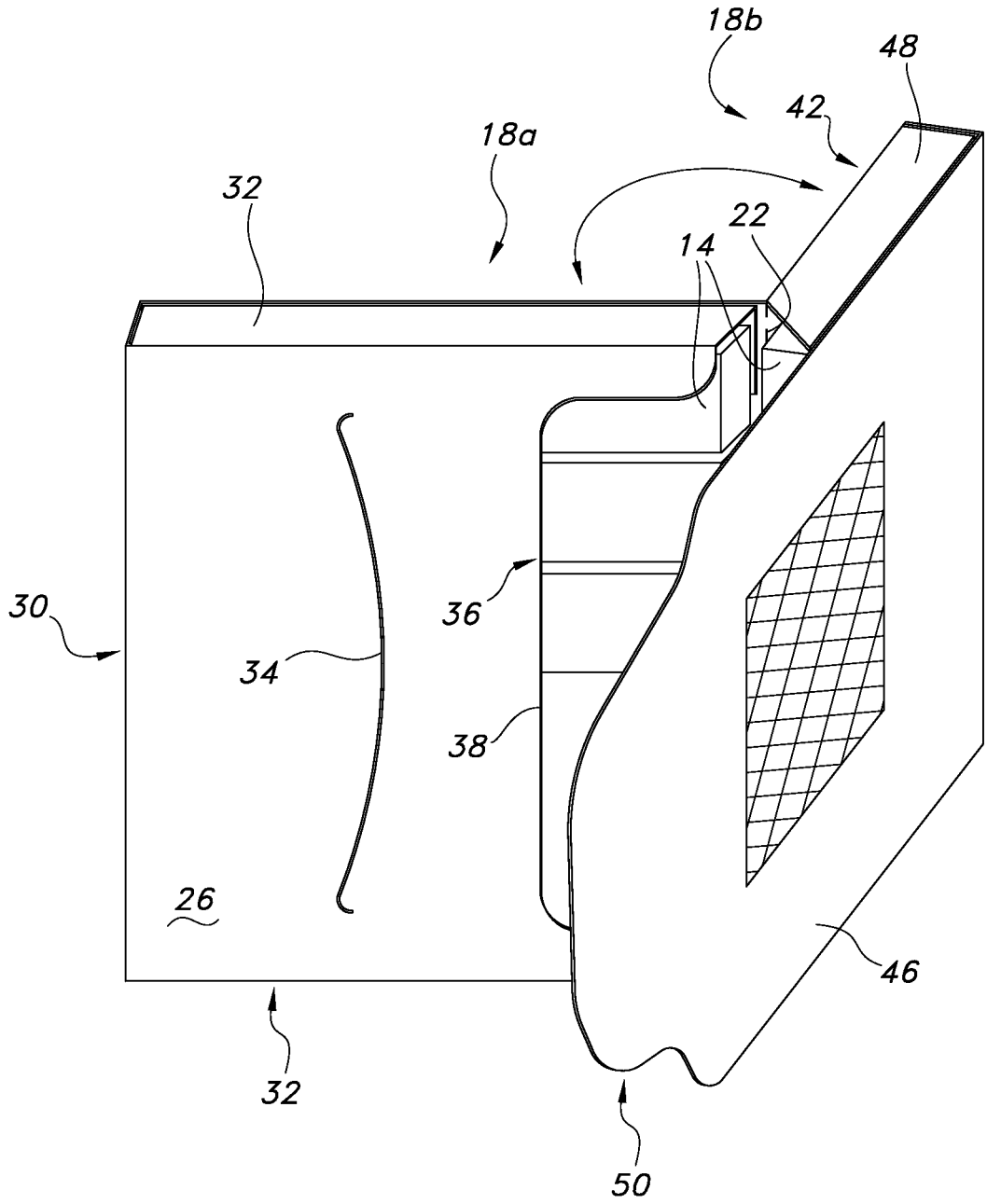
FIG. 3 shows a perspective view of the package of FIG. 1 hinged in a slightly open position.

The pocket 18*a* is formed by a first front wall 26, first back wall portion 28, first bottom wall 30, and first opposing side walls 32 (FIG. 2). The first front wall 26 can include a slot 34 and notch 36. In some embodiments, the slot 34 can have a generally curved configuration. The notch 36 can be formed at an edge 38 of the front wall 26.

Figure 4:
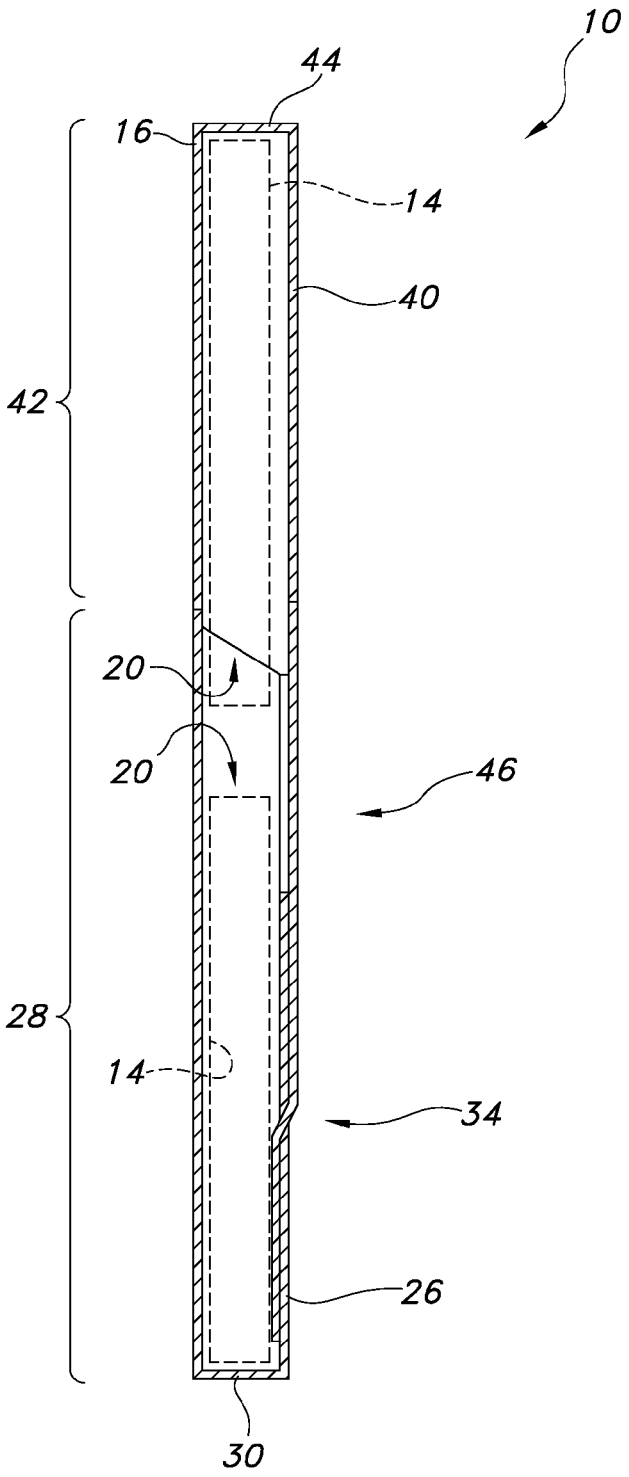
FIG. 4 shows a cross-sectional view along line 4-4 of FIG. 1 to illustrate the package in the closed position.
Figure 5:
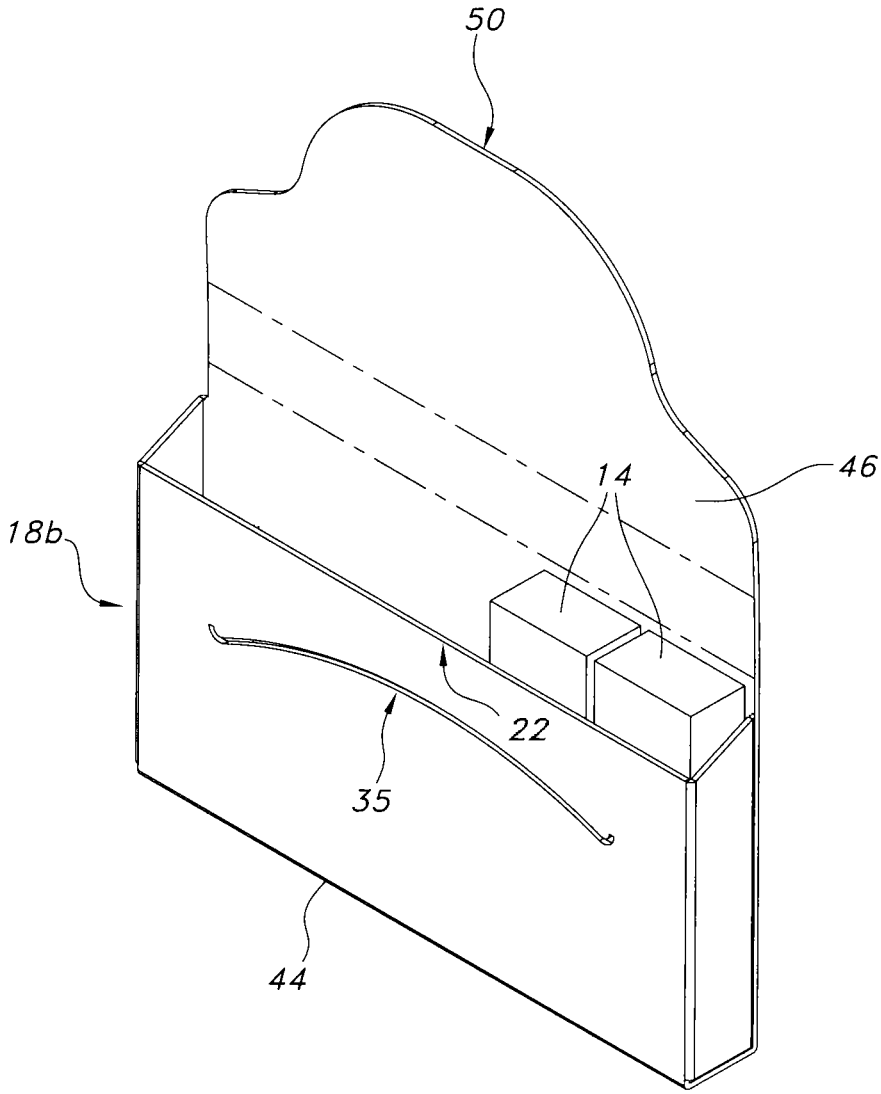
FIG. 5 shows a resized package upon disconnecting product pockets at a fold line.

The pocket 18*b* has a second front wall 40, second back wall portion 42, second bottom wall 44, cover flap 46, and second opposing side walls 48 (FIGS. 2, 3 and 4). The cover flap 46 can be an extension of the second front wall 40 and includes a tab 50, which can be used to selectively hold the packaging assembly 10 in the closed position by interfacing with the slot 34 on the first front wall 36.

A user can manually open the package assembly 10 by grasping in one hand both longitudinal edges of the package and fold the package inwardly along fold line 22. This folding action releases the tab 50 from the slot 34 and opens and folds the package assembly 10 into two side-by-side pockets having vertically offset overlapping arrays of gum slabs 14.

Referring to FIGS. 1 and 4, in the closed position, the packaging assembly 10 has a generally rectangular configuration, although other shapes are possible. The package has a broad front surface formed by the first front walls 26, second front wall 40, and the cover flap 46 and has a broad back surface formed of a common back wall 52, which includes first back wall portion 38 and second back wall portion 42 connected by fold line 22. The open ends 24 of the pockets 18 are in spaced apart facing relationship and are separated by a fold line 22 extending transversely across the back wall between the open ends 24. The front face of one pocket includes a slot 34 while the front face of the other pockets includes a flap 46 extending therefrom having a tab 50 at the distal end 54 thereof for insertion into the slot 34. As shown in FIGS. 1 and 2, the tab 50 is insertable in the slot 34 in the flat condition to provide a closed assembly. The packaging assembly 10 has narrow side edge surfaces, when compared to the broad surfaces, and are formed by the first bottom wall 56, the second bottom wall 44, the first opposing side walls 32, and the second opposing side walls 48.

In the closed position, the pockets 18 are aligned in a substantially coplanar relation with each other and the common back wall 52 is relatively straight and coplanar along the length of the packaging assembly 10 and can have vertical axes 56 and 58, respectively, which are substantially aligned in the closed position. When the packaging assembly 10 is in the closed position, the upper open ends 24 of the pockets 18 face each other so that the pockets 18 open towards each other. The cover flap 46 can overlie the upper open ends 24 to cover the openings 24 when the gum slabs 14 are not being dispensed.

Referring to FIG. 2, in the open position, the packaging assembly 10 is folded about fold line 22 to change the orientation of the pocket 18*b* with respect to the first pocket 18*a* to expose the gum slabs 14 held by the pockets 18 and provided unobstructed access to the gum slabs 14. The package assembly 10 is folded about perorated fold line 22 on the common back wall 52 such that the second back wall portion 42 is rotated by about 180 degrees with respect to the first back wall portion 28 in the closed position, thereby, at least partially folding the common back wall over upon itself. The first back wall portion 28 is preferably longer than the second back wall portion 42 such that the fold line 22 divides the back wall 52 into asymmetrical sections. The second back wall portion 42 preferably folds against the first back wall portion 28 so that there is at least partially overlapping contact between the first and second back wall portions 28 and 42.

In the open position, the pockets 18 assume a generally parallel orientation to each other in a tiered configuration, where the pockets 18*b* has a vertically stepped offset, at least partially overlapping relation, to the pocket 18*a* and the vertical axes 56 and 58 of the first and second compartments can have a generally parallel relation. The first and second bottom wall portions and support the gum slabs 14 in the open position and a have a vertically stepped offset due to the difference in the lengths of the first and second back wall portions and resulting in the tiered configuration of the pockets 18.

When the packaging assembly 10 is in the open position, the openings 24 of the pockets 18 face in the same direction so that the pockets 18 open towards the same direction. The cover flap 46, which was overlying the openings 24 in the closed position, is rotated in unison with the second pocket 18*b* so that the openings 24 are exposed and unobstructed to allow the gum slabs 14 to be dispensed. In the open position, the gum slabs 14 can be aligned in two rows vertically offset from one another in a tiered configuration such that access to the gum slabs 14 from the first pocket 18*a* and/or the second

18*b* is possible. The gum slabs 14 may be removably retained in the pockets 18 by an adhesive which may be overcome by a user pulling on the product pieces.

When the gum slabs have been depleted from the product packet 18*a*, the consumer may wish to reduce the size of the package assembly. To achieve this, the consumer can disconnect the pockets 18 at the area of weakness 22. The area of weakness may include a fold line 22 extending along a width of the package housing which is scored and/or perforated to facilitate separation of the pockets 18*a* and 18*b*. The consumer can discard the pocket 18*a* and retain the pocket 18*b*; thereby forming a new package with a reduced size. The flap of the new package can be selectively retained by a slot 35 formed in the second back wall section 42 of the pocket 18*b*. Unfolded score lines 100 can be included in the flap section to facilitate engagement of the flap 46 with the slot 35. Thus the new package can have a closed position in which the flap is retained by the slot 35 and obstructs access to the gum slabs in the pocket 18*b*, and can have an open position in which the flap 46 is removed from the slot 35 and rotated so that access to the gum slabs 14 in the pocket 18*b* is unobstructed.

Figure 6A:
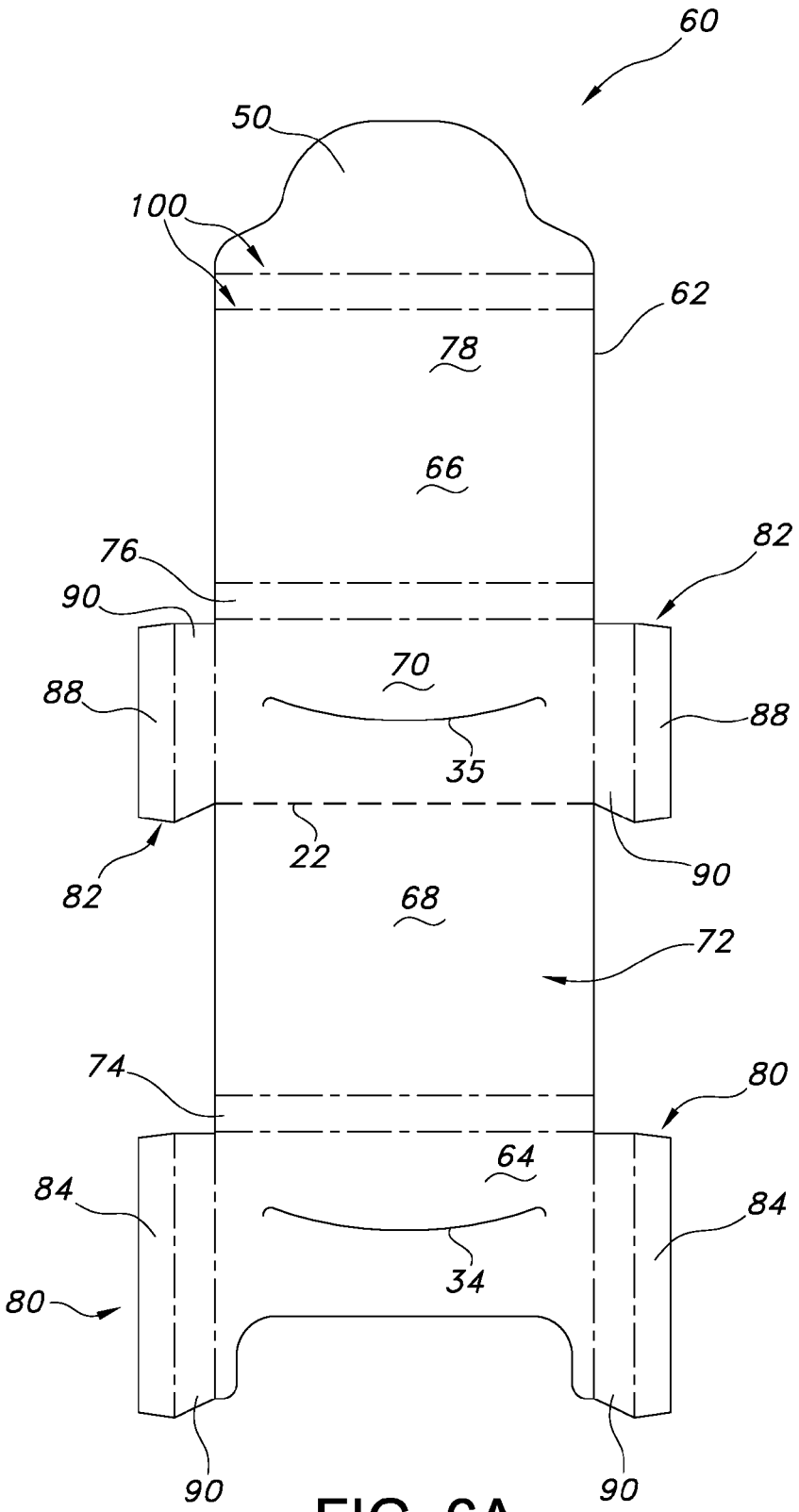
FIGS. 6*a-b* and 7 show plan views of a flat die cut blank used to form exemplary embodiments of the package assemblies.
Figure 6B:
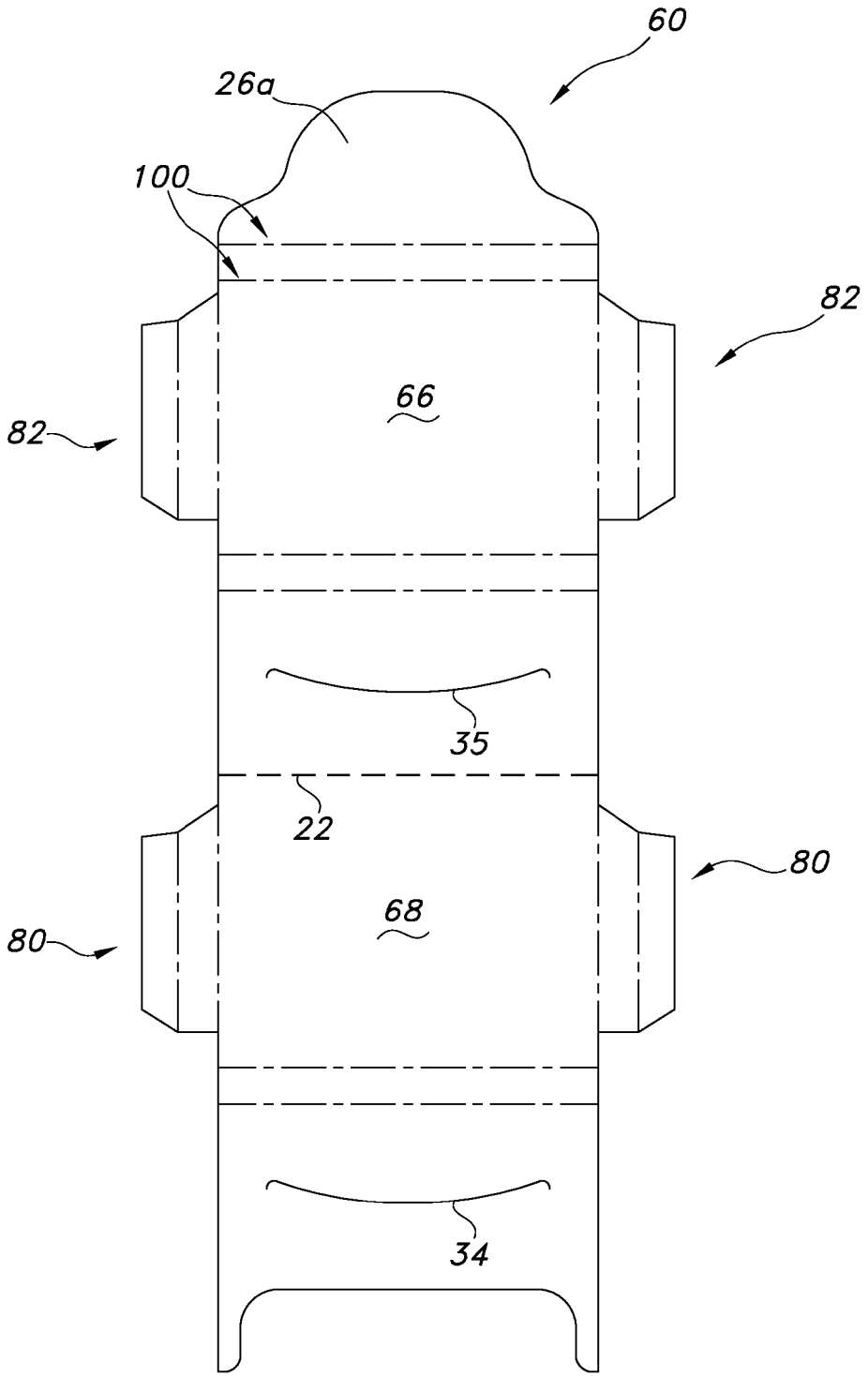
Figure 7:
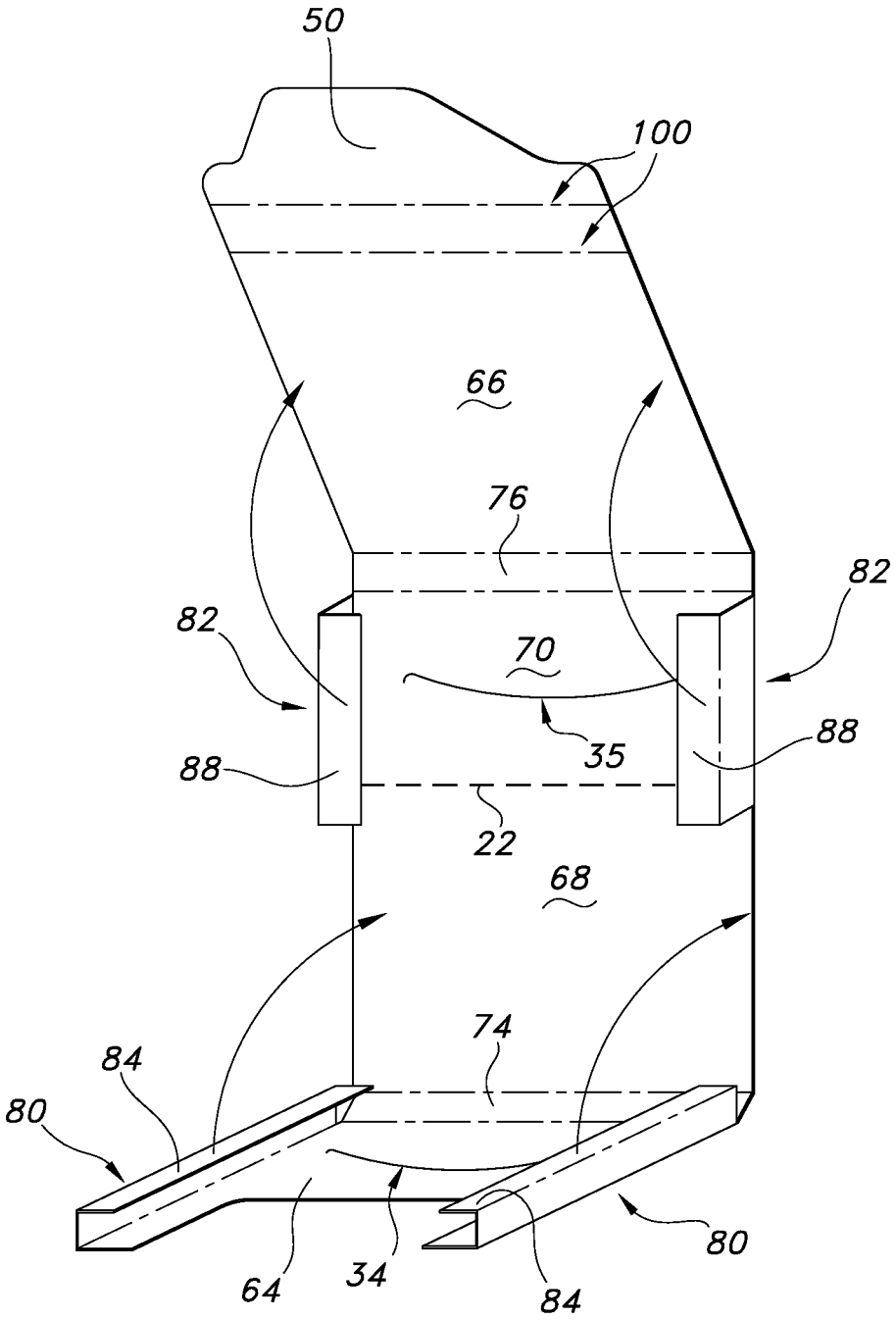

In a preferred embodiment as shown in FIGS. 6*a-b* and 7, the package housing 12 may be formed from a single flat die cut blank of paperboard. Other materials as well as composites thereof may also be used to form the package housing 12. The blank 60 can have a substantially continuous body 62 that can be constructed of a single piece of paperboard or other material of suitable strength for holding one or more consumable products. The body 62 can have first and second front wall sections 64 and 66, first and second back wall section 68 and 70 formed from a common back wall section 72, first and second bottom wall sections 74 and 76, a cover flap section 78, slots 34 and 35, the perforated fold line 22, and unfolded score lines 100. The body 62 can also include side wall tabs 80 and 82.

The body 62 can be folded in a manner such that the first front wall section 64 forms the first front wall 26 with the slot 34, the first back wall portion 68 forms the first back wall portion 28, the first bottom wall section 82 forms the first bottom wall 30, and the side wall tabs 80 form the first opposing side walls 32 of the first pocket 18*a*. The body 62 can also be folded in a manner such that the second front wall section 66 forms the second front wall 40, the second back wall section 70 forms the second back wall portion 42 with the slot 35, the second bottom wall section 76 forms the second bottom wall 44, the side wall tabs 82 form the second opposing side walls 48 of the first pocket 18*a*, and the cover flap section 78 forms the cover flap 46.

The side wall tabs 80 and 82 can be integrally formed such that side wall tabs 80 can be disposed on the sides of the first front wall section 64 and side wall tabs 82 can be disposed on the sides of the second back wall portion 70. While the side tabs 90 are disposed on the sides of the first front wall section 64 those skilled in the art will recognize that the side wall tabs 80 may be disposed on back wall portion 68 (FIG. 6B). Likewise, while the side tabs 82 are disposed on the sides of the second back wall portion 70 those skilled in the art will recognize that the side wall tabs 82 may be disposed on front wall section 66 (FIG. 6B).

Referring to FIGS. 6*a-b* and 7, the blank 60 can be formed into the packaging assembly 10 by folding the side wall tabs 80 so that the side wall tabs 80 are generally orthogonal to the front wall section on which the side wall sections 528*a-b* are disposed and so that the inner surfaces 88 of the side wall tabs 80 are facing each other. Likewise the side wall tabs 82 can be folded inwardly to be generally orthogonal to the second back wall portion 70 so that the inner surfaces 90 are facing each other. Flaps 84 and 86 of the side tabs 80 and 82 can be folded further inward so that the flaps 84 and 86 extend towards each other and are substantially parallel to the first front wall section 64 and the second back wall portion 70, respectively.

The first front wall section 64 can be folded towards the first back wall portion 68 until the flaps 84 contact the first back wall portion 68. The flaps 84 can be adhesively or otherwise joined to the first back wall portion 68, thereby forming the first pocket 18*a*. Likewise, the second front wall section 66 can be folded towards the second back wall portion 70 until the flaps 86 contact the second front wall section 66 and the flaps 86 can be adhesively or otherwise joined to the second front wall section 66, thereby forming the second compartment 140 and the cover flap 152.

Referring to FIGS. 1-7, it can be seen that since the fold line 22 is asymmetrically positioned on the back wall 52, one of the pockets will be at an offset position which is vertically lower with respect to the other pocket. Thus, when the package assembly 10 is opened for dispensing of the gum slabs 14, the user will be presented with two rows. The back row being slightly above the forward row. This facilitates dispensing of the product from both rows. After the desired number of products is dispensed from either or both of the pockets, the package assembly may be moved back to a flat configuration and the tab 50 tucked into the slot 34 to reclose the package assembly.

Figure 8:
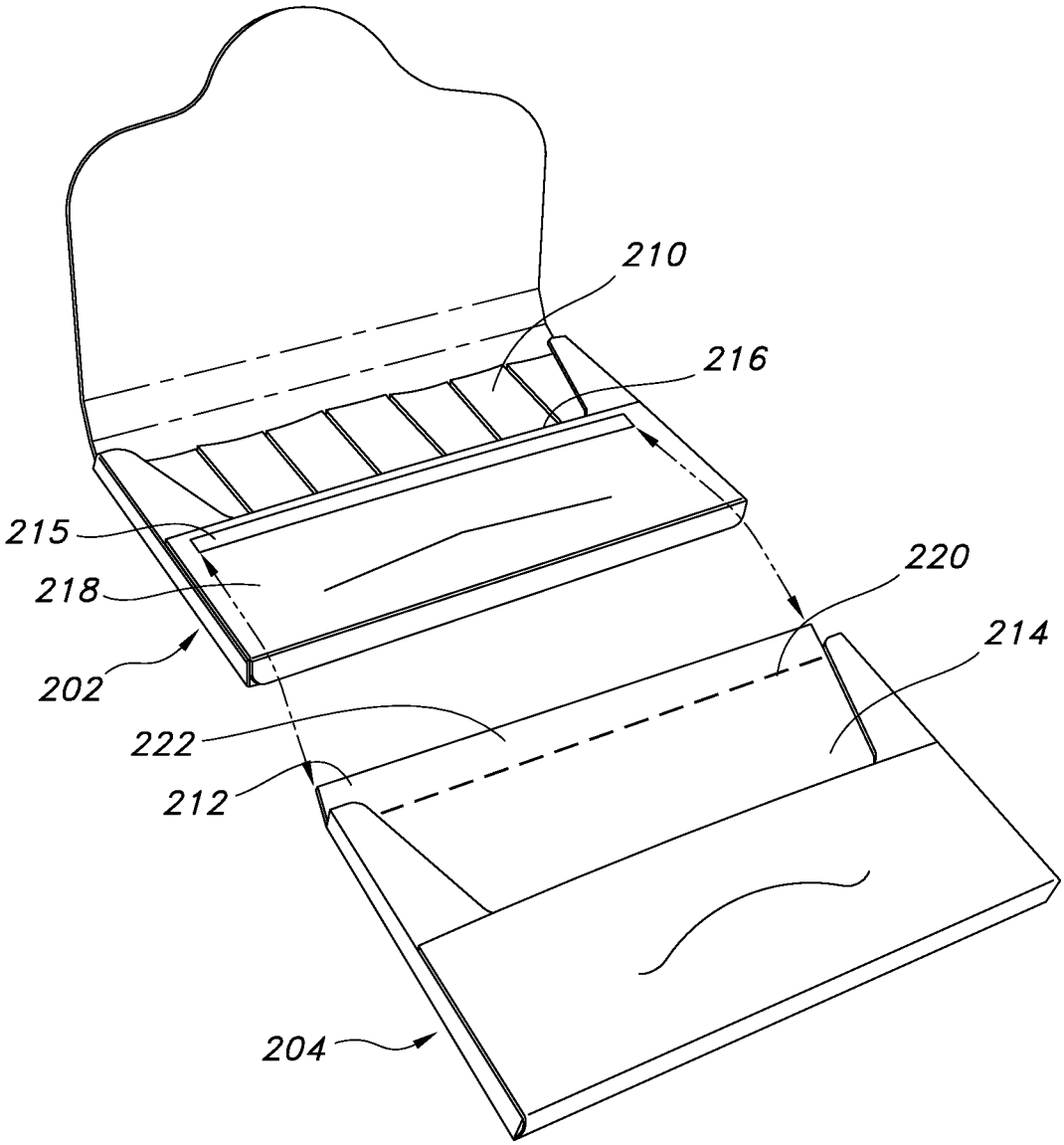
FIG. 8 is a top perspective view showing an alternative embodiment of the package assembly showing a package housing separated into two compartments.
Figure 9:
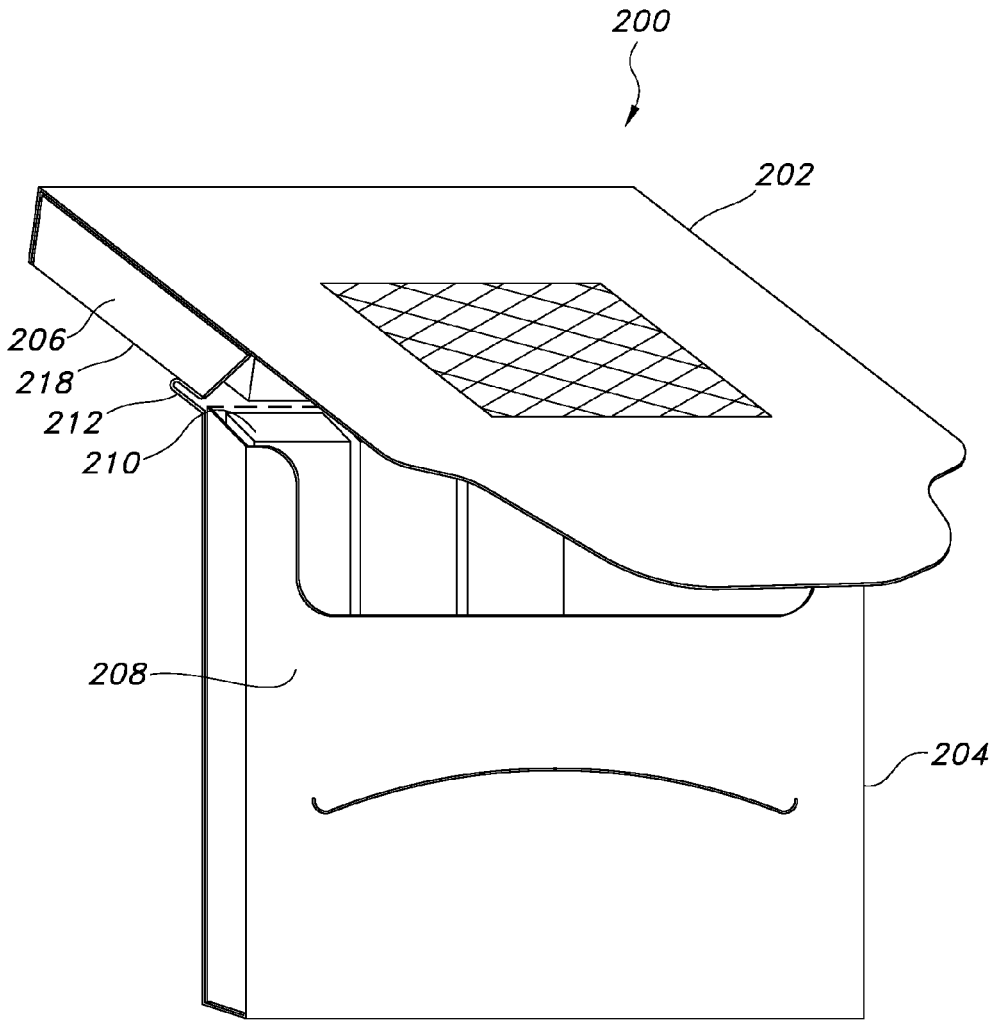
FIG. 9 is a top perspective view showing the two compartments joined together to form the package housing.

A further alternative embodiment is shown in FIGS. 8 and 9. The package housing 200 is similar to that set forth above and shown for example in FIG. 1, but is formed of separate upper and lower compartments 202 and 204 which are joined together to form the package housing 200. The compartments are in the form of product pockets 206 and 208 which hold a plurality of gum pieces 210. The lower compartment may have a connecting flap 212 extending from a back wall portion 214. The connecting flap 212 may be adhered to an attachment area 215 which adjacent to a top edge 216 of an upper compartment front wall 218. When the connecting flap 212 is joined to the upper compartment, the lower compartment may rotate about a fold line 220 formed adjacent to the connecting flap 212.

An area of weakness 222 may be provided between the upper and lower compartments 202 and 204 to facilitate the separation of the compartments. The area of weakness may be formed by treating the fold line 220 to include perforations and/or score lines extending along a width of the package housing. Accordingly, a user could separate the compartments 202 and 204 by tearing along the fold line 220. Alternatively, the area of weakness may be the connection between the connecting flap 212 and the upper compartment 202. The adhesion may be such that when a user pulls the upper and lower compartments apart, the adhesive is overcome thereby separating the compartments.

It is also in the contemplation the present invention that the flap could extend from the upper compartment 202 and be adhered to the back wall 214 portion of the lower compartment.

Having described the preferred embodiments herein, it should now be appreciated that variations may be made thereto without departing from the contemplated scope of the invention. Accordingly, the preferred embodiments described herein are deemed illustrative rather than limiting, the true scope of the invention being set forth in the claims appended hereto.

What is claimed is:

1. A package assembly for containing a plurality of consumable product comprising:

a package housing defining a pair of product pockets connected to each other and rotatable relative to each other, the package housing having a closed position wherein the pair of product pockets are substantially coplanar with one another and an open position wherein the pair of pockets lie in an adjacent overlapping tiered relation, a second of the pair of pockets having a connecting flap extending therefrom, the connecting flap overlying and being connected to a wall of a first of the pair of pockets adjacent to an opening of the first of the pair of pockets;

the housing being foldable to rotate the pair of pockets between the closed position and the open position; and a line of weakness disposed between the connecting flap and the second pocket, and the line of weakness being offset from the opening of the first of the pair of pockets, the pair of pockets being severable from each other at the line of weakness.

2. The package assembly of claim 1, wherein the first one of the pair of pockets has a flap and the second one of the pair of pockets has a slot for receipt of the flap to place the package housing in the closed position.

3. The package assembly of claim 2, wherein the first one of the pair of pockets includes a slot, the flap of the first one of the pair of pockets being selectively received by the slot of the first one of the pair of pockets to close an opening of the first one of the pair of pockets after the pair of pockets are disconnected at the line of weakness.

4. The package assembly of claim 3, wherein the slot of the second one of the pair of pockets is disposed on a front wall of the first one of the pair of pockets and the slot of the second one of the pair of pockets is disposed on a back wall of the first one of the pair of pockets.

5. The package assembly of claim 1, wherein the first one of the pair of pockets forms a separate closable package when the pair of pockets are disconnected at line of weakness.

6. The package assembly of claim 1, wherein each of the pair of pockets includes an opening, the opening of each of the pair of pockets facing each other in the closed position.

7. The package assembly of claim 1, wherein each of the pair of pockets has an opening, and the opening of each of the pair of pockets face in the same direction in the opened position.

8. The package assembly of claim 1, wherein the line of weakness includes a fold line.

9. The package assembly of claim 8, wherein the fold line is scored and/or perforated.

10. The package assembly of claim 9, wherein the fold line is scored and/or perforated along a width of the package housing.

11. The package assembly of claim 1, wherein the connecting flap is adhered to the first of the pair of pockets.

12. A resizable package for holding consumable product comprising:

a first package formed by a first pocket and a second pocket, the first and second pockets having an area of weakness disposed therebetween to permit separation of the first pocket from the second pocket, the first and second pockets being rotatable with respect to the other between a closed position of the first package and an open position of the first package, the first pocket including a slot for selectively retaining a flap extending from the second pocket to hold the first package in the closed position, the first and second pockets being substantially coplanar with one another in the closed position and lying in an adjacent overlapping offset tiered relation in the open position, and wherein the first pocket and second pocket are joined together at the area of weakness by a connecting flap and the connecting flap extends from the second pocket and is adhered to the first pocket; and a second package formed upon disconnecting the second pocket from the first pocket at the area of weakness, the second pocket including a slot for selectively retaining the flap extending from the second pocket to hold the second package in the closed position, the second package being smaller than the first package.

13. The resizable package of claim 12, wherein the slot of the first pocket is disposed on a front wall of the first pocket and the slot of the second pocket is disposed on a back wall of the second pocket.

14. The resizable package of claim 12, wherein each of the first and second pockets include an opening, the opening of each of the first and second pockets facing each other in the closed position of the first package.

15. The resizable package of claim 12, wherein each of the first and second pockets have an opening, the opening of each of the first and second pockets facing in the same direction in the opened position of the first package.

16. The resizable package of claim 12, wherein the area of weakness includes a fold line.

17. The resizable package of claim 16, wherein the fold line is scored and/or perforated.

18. The resizable package of claim 17, wherein the fold line is scored along a width of the second pocket.

19. A package assembly for containing pieces of an edible product, comprising:

a package housing having an upper compartment and a lower compartment, each compartment being formed to receive and contain a plurality of individual pieces of an edible product, the upper and lower compartments being rotatable relative to each other;

the package housing having a closed position wherein the upper and lower compartments are substantially coplanar with one another and an open position wherein the upper and lower compartments lie in an adjacent overlapping tiered relation;

a connecting flap extending between and joining the upper and lower compartments; and the upper and lower compartments are separable from each other along an area of weakness adjacent to the connecting flap, and wherein the connecting flap extends from the lower compartment and is adhered to the upper compartment.

20. The package assembly of claim 19, wherein the connection of the connecting flap to the upper compartment is treated to assist in separating the compartments from each other.

21. The package assembly of claim 19, wherein the connecting flap is treated by creating a perforated score line.

22. The package assembly of claim 19, wherein the area of weakness includes the area over which the connecting flap is adhered to the upper compartment.

23. The package assembly of claim 19, wherein the adhesion between the connecting flap and the upper compartment is overcome by pulling the upper compartment from the lower compartment, whereby the upper and lower compartments are separated from each other.

24. A method of forming a resizable package for holding consumable product comprising:

a package having a first and second pocket formed from a blank and the first pocket and second pocket are joined together at the area of weakness by a connecting flap and the connecting flap extends from the second pocket and is adhered to the first pocket, the package having a closed position in which the first and second pockets are substantially coplanar with one another and a flap extending from the first pocket is selectively retained by a slot formed in the a front wall of the second pocket to obstruct access to the first and second pockets and an open position in which the first and second pockets lie in an adjacent overlapping tiered relation upon rotating the first and second pockets with respect to each other so that openings of the first and second pockets are unobstructed by the flap;

disconnecting the second pocket from the first pocket at the area of weakness to form a second package, the second pocket including a slot; and selectively retaining the flap extending from the second pocket with the slot of the second pocket to hold the second package in the closed position, the second package being smaller than the first package.

25. The method of claim 24, wherein the blank includes a first front wall section, a first back wall portion, and a first set of side tabs extending from opposite sides of one of the first front wall section or the first back wall portion and the method further comprises joining the set of side tabs to one of the first front wall section or the first back wall portion to form the first pocket.

26. The method of claim 25, wherein the blank includes a second front wall section, a second back wall portion, and a second set of side tabs extending from opposite sides of one of the second front wall section or the second back wall portion and the method further comprises joining the set of side tabs to one of second front wall section or the second back wall portion to form the second pocket.

27. The method of claim 24, wherein disconnecting is performed when the consumable product contained in the first pocket has been depleted and the method further comprises discarding the first pocket.

* * * * *